US005447115A

United States Patent [19]

Moody

[11] Patent Number: 5,447,115

[45] Date of Patent: Sep. 5, 1995

[54] UNDERWATER VEHICLE RECOVERY SYSTEM

[75] Inventor: Paul E. Moody, Barrington, R.I.

[73] Assignee: The United States of America as represented by the Secretary of the Navy, Washington, D.C.

[21] Appl. No.: 269,430

[22] Filed: Jun. 30, 1994

[51] Int. Cl.[6] ..... B63G 8/00

[52] U.S. Cl. ..... 114/312; 114/316

[58] Field of Search ..... 114/312, 238, 239, 316, 114/50, 244, 253, 254; 405/188

[56] References Cited

U.S. PATENT DOCUMENTS

| | | | |
|---|---|---|---|
| 1,985,184 | 12/1934 | Methlin | 114/238 |
| 3,034,471 | 5/1962 | Aschinger | 405/188 X |
| 3,245,373 | 4/1966 | Sibold, Jr. | 114/244 |
| 3,298,347 | 1/1967 | Swain et al. | 114/312 |
| 3,626,703 | 12/1971 | Richburg | 114/312 |
| 3,943,875 | 3/1976 | Sanders | 114/244 |
| 4,304,189 | 12/1981 | Wright | 114/244 X |
| 4,388,709 | 6/1983 | Reed et al. | 114/244 X |
| 5,363,791 | 11/1994 | Stallard, III | 114/238 X |

*Primary Examiner*—Sherman Basinger

*Attorney, Agent, or Firm*—Michael J. McGowan; Prithvi C. Lall; James M. Kasischke

[57] ABSTRACT

An unmanned underwater vehicle recovery device being joinable with the breech of an existing torpedo tube. The recovery device comprises a plurality of concentric tubes which telescope through the torpedo tube to the exterior of the hull of a submarine to provide a mechanism for aligning the recovered unmanned underwater vehicle with the torpedo tube launchway. A recovery vehicle is held within the recovery device by a deployable tether. During recovery the recovery vehicle is launched from the recovery device in the torpedo tube of the submarine. The recovery vehicle travels out and mates with a coupling at the rear of the unmanned underwater vehicle. The tether is retracted and joined recovery vehicle/unmanned underwater vehicle is pulled into the torpedo tube launchway. The concentric tubes are retracted and the unmanned underwater vehicle is left in the torpedo tube.

11 Claims, 4 Drawing Sheets

UNDERWATER VEHICLE RECOVERY SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

The present invention relates to an underwater recovery means for recovering unmanned underwater vehicles and more particularly to a means for recovering unmanned underwater vehicles by a submarine through a torpedo launch tube.

2. Description of the Prior Art

The United States Navy has a number of initiatives underway to develop unmanned underwater vehicles (UUVs). The anticipated missions for these vehicles are quite diverse; however, some of the missions require a UUV launch from a submarine to conduct covert operations. The UUV is limited in size in order that it fit within a torpedo tube with enough internal volume to contain a propulsion system, a navigation system, data gathering equipment and other special purpose equipment associated with the particular mission of the UUV. The UUV is launched from the torpedo tube either by the submarine's weapon ejection system or the UUV's own propulsion system.

The United States Navy needs the capability of retrieving these UUVs by a submarine after launch. Retrieval of the UUV is desirable not only because of the UUV's multi-million dollar cost, but also because of the need to retrieve intelligence data the vehicle has gathered and to prepare the vehicle for subsequent missions.

Many options have been considered for submarine retrieval of UUVs. The UUV can be retrieved by attaching it to the outside of the pressure hull but this requires the development of an external retrieval system and increases the ship's acoustic signature. Furthermore, a UUV attached externally to the hull of the submarine is inaccessible for data gathering and maintenance. Scuttling the UUV after it has accomplished its mission is expensive and does not allow retrieval of UUV data gathered during the mission. Using a surface ship to retrieve the UUV destroys the clandestine nature of the UUV's mission and requires that a submarine carry multiple UUVs for multiple covert missions. Use of a line/hook system launched from the torpedo tube to connect with a line/hook system deployed from a returning UUV has also been considered, but this method does not align the returning UUV with the torpedo tube and launchway resulting in possible damage to the UUV or hang up when the UUV is retracted into the ship.

For these reasons, the retrieval means should allow the UUV to be retrieved within the hull of the submarine. Without extensive modification of the submarine, the torpedo tube hatch is the only submarine hull opening with a large enough aperture to allow entry of the UUV upon retrieval. Torpedo tube retrieval is complicated by several factors. Most UUV designs make full use of the space available in the 21 inch diameter torpedo tube leaving little space for a retrieval system in the torpedo tube. UUV designs are weight critical and, therefore, are designed with delicate control surfaces and minimal impact or load carrying capability beyond the loads imposed by hydrodynamic forces. Even under moderate ship speed, a complex flow field exists in the torpedo tube shutter area which exerts significant lateral forces on any vehicle attempting to exit or enter the torpedo launch system's shutterway. The UUV retrieval system must draw the vehicle into the torpedo tube tail first because space within the torpedo room is insufficient to turn the vehicle around for a subsequent launch. Significant ship modifications using a new hull penetration or replacing a major ship component are cost prohibitive.

SUMMARY OF THE INVENTION

Accordingly, it is a general purpose and object of the present invention to provide a device for retrieving an unmanned underwater vehicle by a submarine.

It is a further object that such retrieval device allow data recovery and reuse of the unmanned underwater vehicle.

Another object is that such device be deployable in existing submarines without radical modification of the submarine's design.

These objects are accomplished with the present invention by providing an unmanned underwater vehicle recovery device joinable with the breech of an existing torpedo tube. The recovery device comprises a plurality of concentric tubes which telescope through the torpedo tube to the exterior of the hull of the submarine to provide a means for aligning the recovered UUV with the torpedo tube launchway. A recovery vehicle is held within the recovery device by a deployable tether. During recovery the recovery vehicle is launched from the recovery device in the torpedo tube of the submarine. The recovery vehicle travels out and mates with a coupling at the rear of the UUV. The tether is retracted and joined recovery vehicle/UUV is pulled into the torpedo tube launchway. The concentric tubes are retracted and the UUV is left in the torpedo tube.

BRIEF DESCRIPTION OF THE DRAWINGS

A more complete understanding of the invention and many of the attendant advantages thereto will be readily appreciated as the invention becomes better understood by reference to the following detailed description when considered in conjunction with the accompanying drawings wherein.

DESCRIPTION OF THE PREFERRED EMBODIMENT

Figure 1:
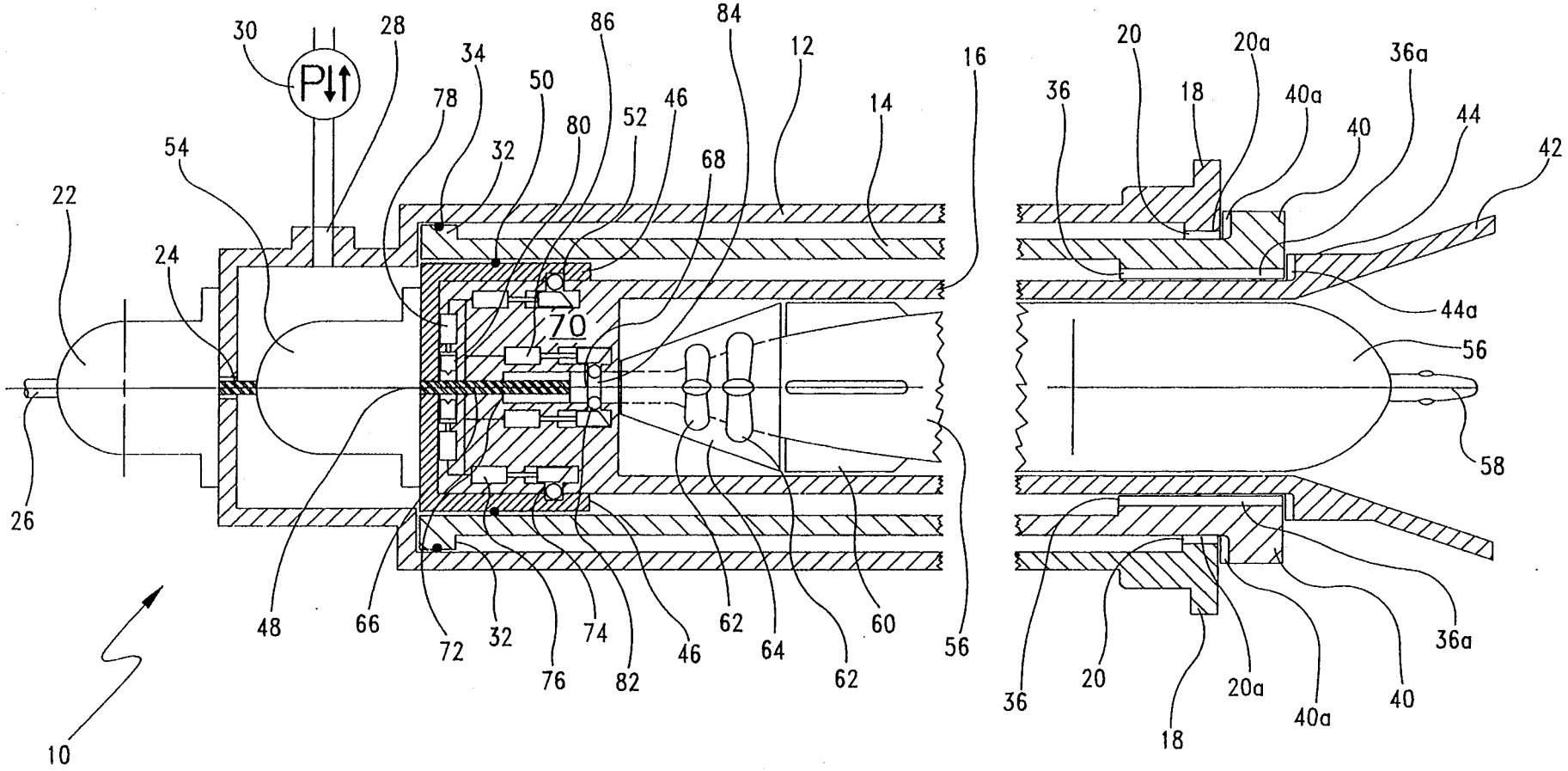
FIG. 1 shows a cut away view of the inventive device retracted.

In FIG. 1 there is shown an underwater vehicle recovery device of the current invention. Device 10 is cylindrical with a proximate end and a distal end. Underwater vehicle recovery device 10 comprises three hollow, concentric cylinders, an outer cylinder 12, an intermediate piston 14, and an inner piston 16. FIG. 1 shows pistons 14 and 16 retracted.

To provide for mounting of recovery device 10 to a torpedo tube, outer cylinder 12 has an outer cylinder mounting flange 18 disposed at the distal end of outer cylinder 12. Outer cylinder mounting flange 18 has fixtures thereon allowing flange 18 to seal distal end of device 10 against a torpedo tube inboard opening (see FIG. 2). On the inner surface of the distal end of outer cylinder 12 there is an outer cylinder extension stop flange 20, the function of which will be discussed in the ensuing text. Stop flange 20 has a plurality of outer cylinder flood vents 20*a* therein to allow flooding of the distal end of outer cylinder 12. A piston retraction winch 22 having a piston retraction cable 24 stowed therein is disposed at the proximate end of outer cylinder 12. Winch 22 acts to seal the proximate end of outer cylinder 12 while allowing communication through cable 24. An electrical connection 26 allows communication of power and control signals through winch 22 to other parts of vehicle recovery device 10. The proximate end of outer cylinder 12 also has a pump/vent aperture 28 therein to allow attachment of a pump 30 thereto.

Nested within outer cylinder 12 is intermediate piston 14. Intermediate piston 14 is a cylinder open at both ends. On the exterior surface of the proximate end of intermediate piston 14 there is an intermediate piston extension stop flange 32 positioned to interfere with outer cylinder extension stop flange 20 and thereby prevent intermediate piston 14 from extending beyond outer cylinder 12. On the outermost surface of intermediate piston extension stop flange 32 is an intermediate piston o-ring 34 to seal the outer surface of intermediate piston 14 against the inner surface of outer cylinder 12. An intermediate piston retraction stop flange 36 is disposed on the inner surface of the distal end of intermediate piston 14. Intermediate piston retraction stop flange 36 has a stop flange flood vent 36*a* therein to promote flooding of intermediate piston 14. An intermediate piston support flange 40 is positioned on the outer surface of the distal end of intermediate piston 14 to support the distal end of piston 14 against a torpedo tube (not shown). Support flange 40 has a plurality of support flange flood vents 40*a* therein to promote flooding of outer cylinder 12.

Inner piston 16 is nested within intermediate piston 14. The distal end of inner piston 16 is flared to form a conical mouth 42. Where conical mouth 42 joins inner piston 16, a shoulder 44 is defined having shoulder flood vents 44*a* therein for flooding intermediate piston 14. On the outer surface of inner piston 16 near the proximate end thereof is disposed an inner piston extension retaining cup 46. Inner piston extension retaining cup 46 surrounds the proximate end of inner piston 16 with a tether aperture 48 at the center of the base of retaining cup 46. Inner piston extension retaining cup 46 retains inner piston 16 in intermediate piston 14 by interference with intermediate piston retraction stop flange 36 at the distal end of intermediate piston 14. On the outermost surface of inner piston extension retaining cup 46 is an inner piston o-ring 50 to seal the outer surface of inner piston 16 against the inner surface of intermediate piston 14. The interior surface of inner piston extension retaining cup 46 has an annular cup locking groove 52 thereon. A vehicle control tether winch 54 is disposed on the proximate end of the base of retaining cup 46 and in communication with inner piston 16 through tether aperture 48 in piston retaining cup 46.

A recovery vehicle 56 is disposed within inner piston 16. Recovery vehicle 56 has a male recovery coupling 58 disposed at the distal end thereof. Male recovery coupling 58 can be any positively locking coupling such as that disclosed in U.S. Pat. No. 3,943,875 or the like. Near the proximate end of recovery vehicle 56 there are mounted horizontal and vertical control fins 60 to control vehicle 56. Disposed at the proximate end of recovery vehicle 56 is a propulsion means 62 having a conical shroud 64 thereabout to aid in recovery of vehicle 56. A vehicle control tether 66 is attached to vehicle 56 at a vehicle retention collar 68 behind propulsion means 62. Vehicle control tether 66 has both strength bearing and electrical transmission members to allow retraction of vehicle 56 and transmission of signals or power.

A vehicle jettison module 70 is within inner piston 16 near the proximate end thereof between recovery vehicle 56 and inner piston extension retaining cup 46. Jettison module 72 has a channel 72 at the center line of piston 16 for vehicle control tether 66. Jettison module 70 allows jettison of inner piston 16 from retaining cup 46. In ordinary operation, inner piston extension retaining cup 46 is locked to inner piston 16 by retaining cup ball locks 74 in cup locking groove 52. In an emergency, a signal can be sent to cup solenoids 76 to unlock retaining cup ball locks 74. Tether 66 is cut by actuating cutting solenoids 78 which causes blades 80 to cut tether 66. Inner piston 16 is discharged from the torpedo tube by activating the torpedo tube ejection system. Recovery vehicle 56 can also be abandoned in an emergency situation by cutting tether 66. Note that if an emergency jettison is necessary, intermediate piston 14 remains in the torpedo tube along with inner piston extension retaining cup 46. This minimizes the jettison of large parts which can get caught in the launchway beyond the torpedo tube's muzzle face.

Jettison module 70 also has a role in the initial launch of recovery vehicle 56. Recovery vehicle 56 is shown locked into jettison module 70 by vehicle retention ball locks 82. Ball locks 82 retain vehicle 56 by forcing a ball into an annular channel 84 in retention collar 68. Retention ball locks 82 release vehicle 56 on receipt of a signal at release solenoids Both the UUV and the UUV recovery system are designed to be no greater in diameter and length than a large, standard, submarine launched torpedo. This allows the UUV and recovery system to be loaded onto the ship by the normal weapon shipping system, and it allows the UUV and recovery system to be launched from existing ships without extensive modification.

Figure 2:
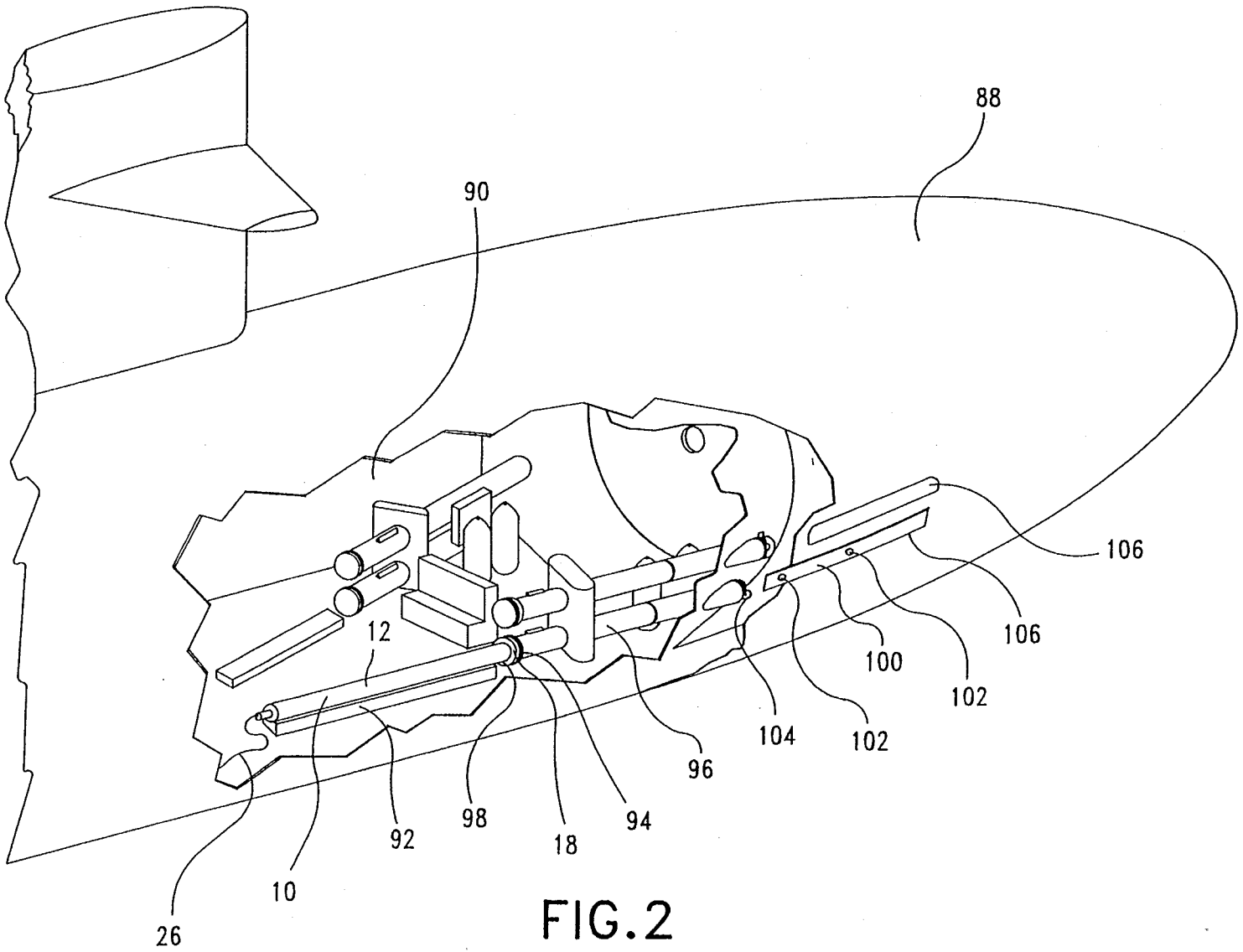
FIG. 2 shows a partially cut away view of a submarine revealing the inventive device in its retracted state mounted to a torpedo tube.

Referring now to FIG. 2 there is shown a partially cut away view of a submarine 88 showing the ship's torpedo room 90. When recovery of a UUV is necessary, recovery device 10 is moved to torpedo load line 92 in its retracted configuration. Recovery device 10 must be less than the maximum torpedo room storage length. Recovery device 10 is moved forward until outer cylinder mounting flange 18 on outer cylinder 12 of recovery device contacts breech face 94 of torpedo tube 96. Outer cylinder mounting flange 18 complements breech door locking ring 98 of torpedo tube 96, thereby allowing breech door locking ring 98 to be rotated to lock recovery device 10 to torpedo tube 96 while simultaneously sealing device 10 against breech face 94 of torpedo tube 96. After mounting device 10, it is lashed in place by the ship's cradle/lashing strap mechanism. An external pump is connected with pump/vent aperture in the proximate end of outer cylinder 12 (see FIG. 1). Control and power circuitry is connected to tether 66. Because recovery device 10 is the same diameter as a torpedo, an existing cradle/lashing strap mechanism can be used to lash down recovery device 10 to insure that device 10 does not move should ship 88 be subjected to unanticipated motion. Launchway 10O of submarine 88 is provided with extensible supports 102 as near as possible to the distal end of device 10 when extended. Supports 102 are hydraulically actuated but can also be pneumatically or electrically actuated.

After joining device 10 to torpedo tube 96 is flooded equalizing its internal pressure with the outside sea pressure, and torpedo tube muzzle door 104 and shutter 106 are opened. Recovery device 10 is extended just prior to the return of the UUV because device 10 blocks closing both torpedo tube muzzle door 104 and shutter 106. When torpedo tube 96 is flooded, so is the inside of recovery device Referring again to FIG. 1, flooding is aided by flooding vents 20*a*, 36*a*, 40*a*, and 44*a* located in the distal end of outer cylinder 12 and pistons 14 and 16. Since water at sea pressure is present on both sides of intermediate piston 14 and inner piston 16, only outer cylinder 12 is subject to sea pressure; therefore, outer cylinder 12 is the only part of device 10 subject to submarine safety requirements. Telescoping pistons 14 and 16 have equal pressure on both the interior and exterior of their walls and are therefore not subject to the same pressure loads as outer cylinder 12. O-rings 34 and 50 seal pistons 14 and 16 against each other at the proximate or torpedo room end.

Pump 30 is used to extend pistons 14 and 16 by pumping water into the proximate end of device 10 via pump/vent aperture 28. Because intermediate piston extension stop flange 32 is sealed by intermediate piston o-ring 34, and inner piston extension retaining cup 46 is sealed by inner piston o-ring 50, pumped water pushes both pistons 14 and 16 to their extended positions. While pistons 14 and 16 are extending, piston retraction winch 22 mounted on the proximate end of outer cylinder 12 releases sufficient cable 24 to permit full extension of pistons 14 and 16. After recovery, cable 24 is used to retract pistons 14 and 16. Retraction winch 22 also functions to indicate the amount that recovery device 10 has extended. Piston retraction cable 24 provides electrical power and control signals to jettison control means 70 and vehicle control tether winch 54. Piston retraction cable 24 can also be used to distribute electrical power and control signals to recovery vehicle 56 via tether 66.

Once device 10 has reached its fully extended position, extensible supports 102 (See FIG. 2) are actuated to provide support for inner piston 16. Supports 102 must be located as close to the distal end of inner piston 16 as possible to minimize the cantilevered length of piston 16 and thereby minimize stresses and vibrations. Torpedo tube retraction stop flange 36 and inner piston extension retaining cup 46 provide adequate length to diameter support of inner piston 16 prior to the actuation of extensible supports 102.

Figure 3:
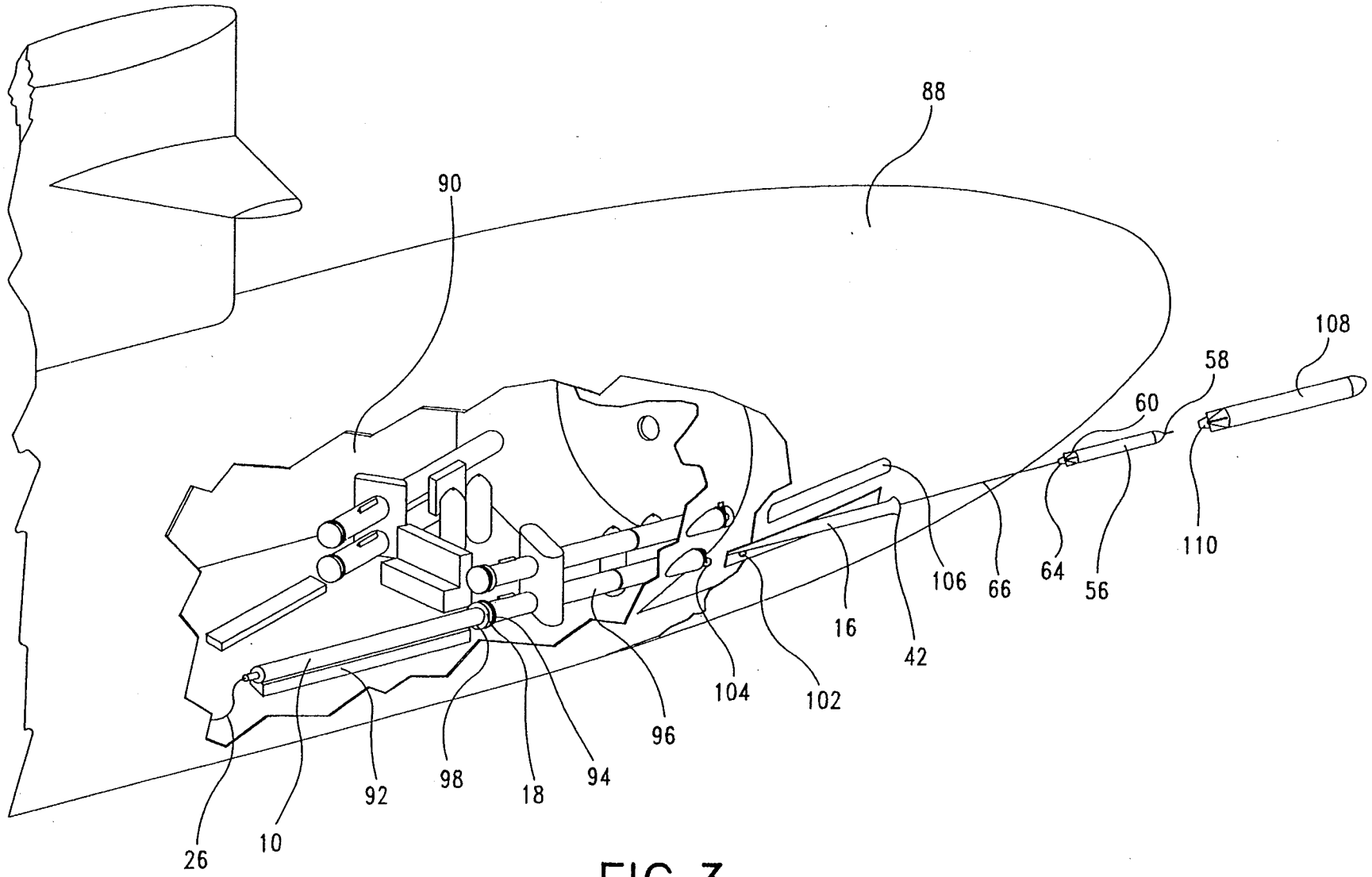
FIG. 3 shows a partially cut away view of a submarine revealing the inventive device as in operation.

Referring now to FIG. 3 there is shown a partially cut away view of a submarine with the recovery device extended. When a UUV 108 returns to submarine 88, UUV 108 is directed to maneuver at approximately the same speed as submarine 88 in a parallel direction. Once UUV 108 is positioned forward of torpedo tube shutter 106, it activates a homing beacon. The beacon can be a low power directional radio transmitter, an acoustic transmitter, or the like.

Before recovery of UUV 108 can occur, all projections on UUV 108 including the UUV guide stud are either jettisoned or retracted into the UUV's body to prevent UUV 108 from jamming while being pulled into submarine 88. (A guide stud interacts with a track in the torpedo tube to prevent a vehicle from spinning in the torpedo tube during launch because of the action of the vehicle's propulsor.) UUV 108 has a conical tail shroud 110 with dimensions corresponding to that of mouth 42. UUV 108 is also equipped with an electronic or acoustic transmitter to permit recovery vehicle 56 to home in on UUV 108 and a female recovery coupling to receive male recovery coupling 58 on recovery vehicle 56.

On reception of the transmission from UUV 108, recovery vehicle 56 is released from inner piston 16. Using its propulsor, vehicle 56 moves out of inner piston 16. Vehicle control tether 66 interfaces with vehicle control tether winch 54 to provide a physical connection between submarine 88 and recovery vehicle 56 as vehicle 56 swims toward UUV 108. Recovery vehicle 56 receiver searches for the signal transmitted by UUV 108 and uses the transmitted signal to guide recovery vehicle 56 to the tail of UUV 108. Because the speed of recovery vehicle 56 is greater than that of UUV 108, recovery vehicle 56 overtakes UUV 108 and physically attaches to UUV 108 by male recovery coupling 58 uniting with the female recovery coupling (not shown) on UUV 108. The female recovery coupling, like male recovery coupling 58, can be similar to that taught by U.S. Pat. No. 3,943,875 or the like.

Once recovery vehicle 56 and UUV 108 are locked together, they continue to propel themselves in the same direction as submarine 88 but at a slightly greater speed. Recovery vehicle 56 transmits an electrical signal through tether 66 indicating that recovery vehicle 56 has coupled with UUV 108, and vehicle control tether 66 stops uncoiling and starts to draw vehicles 56 and 108 back toward torpedo tube shutter 106. As vehicles 56 and 108 are drawn close to submarine 88, they encounter a flow field around submarine 88 which tends to cant their centerline axis away from that of torpedo tube 96. Mouth 42 of inner piston 16 and recovery vehicle's propulsion system shroud 64 are generally conical to prevent canted vehicles 56 and 108 from hanging in inner piston 16. Recovery vehicle 56 also can utilize its control fins 60 to compensate for the flow field forces. Shroud 64 on recovery vehicle 56 is ruggedly constructed to withstand the forces caused by vehicle control tether winch 54 forcing alignment of mouth 42 and vehicle 56, as vehicle 56 enters inner piston 16.

After recovery vehicle 56 is forced into alignment with inner piston 16, winch 54 continues to draw vehicle 56 into inner piston 16 until conical shroud 110 on tail of UUV 108 nests in conical mouth 42 of inner piston 16. Because recovery vehicle 56 and UUV 108 are physically attached to each other with a common centerline, UUV 108 is aligned with conical mouth 42 when recovery vehicle 56 is retracted. However, by UUV's shroud 110 nesting in conical mouth 42, stability and support to the connection between UUV 108 and recovery device 10 is increased.

Figure 4:
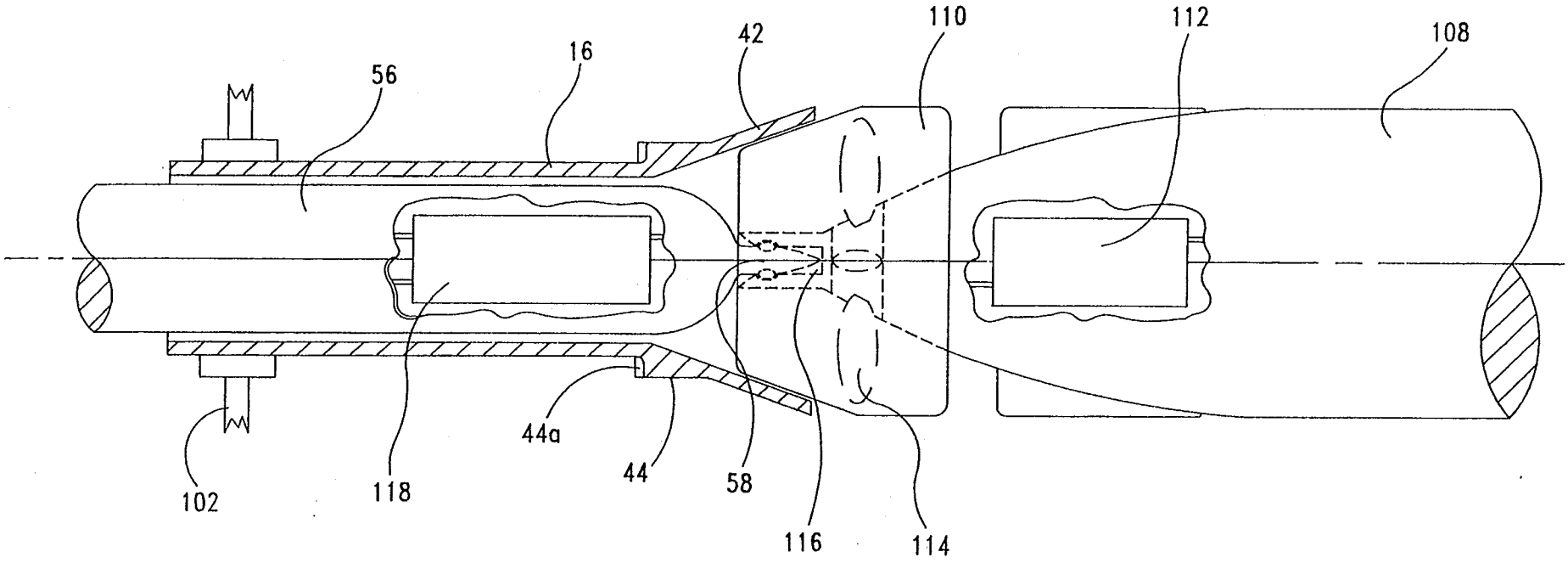
FIG. 4 shows a partially cut away view of a recovery vehicle joined with an underwater vehicle with the device partially retracted.

Referring now to FIG. 4 there is shown a partially cut away view of the distal end of device 10 before it is retracted. UUV 108 is partially cut away to show transmission circuitry 112 disposed aboard UUV 108. UUV propulsor 114 and female recovery coupling 16 are shown with hidden lines behind conical shroud 110. Recovery vehicle 56 is partially cut away to show homing circuitry 118 disposed therein to allow recovery vehicle 56 to track UUV 108. The backside of conical mouth 42 on the distal end of inner piston 16 is also conical to allow inner piston 16 to ride over torpedo tube 96 edges or corners when subject to misalignment caused by flow field loading.

As recovery vehicle 56 and UUV 108 assembly is drawn into torpedo tube 96, conical mouth 42 restrains UUV 108 and prevents it from coming in contact with torpedo tube shutter 106. This restraint permits the retrieval of UUV 108 without unacceptable damage to either UUV 108 or submarine 88.

Inner piston 16 is retracted as soon as UUV shroud 110 nests in conical mouth 42. Launchway extendible supports 102 are retracted in two steps. The first step is to partially loosen the grip of supports 102 on inner piston 16. This allows piston 16 to be drawn through extensible supports 102 to the point where shoulder 44 of conical mouth 42 contacts extensible support 102. Inner piston 16 is thus supported when subjected to flow field loads tending to pivot UUV 108. Extensible supports 102 are fully retracted when conical mouth 42 nears extensible support 102. At this stage, the length of inner piston 16 exposed to the flow field is shortened, significantly reducing the applied bending moment.

After UUV 108 is nested into conical mouth 42 and launchway extensible supports 102 are partially retracted, the water supply used to extend intermediate piston 14 and inner piston 16 is vented in a controlled manner via pump/vent aperture 28 to prevent excess sea pressure from causing recovery device 10 to retract with excessive energy. See FIG. 1. The retraction speed of pistons 14 and 16 is also controlled to allow retraction winch 22 to draw in cable 24 and prevent slack from occurring between retraction winch 22 and the proximate side of vehicle control tether winch 54. At shallow depths, sea pressure can be insufficient to return pistons 14 and 16 to their fully retracted position, and retraction winch 22 is necessary to retract inner piston 16.

Referring now to FIG. 2. Once recovery device 10 is fully retracted, UUV 108 is completely within torpedo tube 96. Thereafter, torpedo tube shutter 106 and muzzle door 104 is closed, and recovery device 10 is drained through flooding vents 20*a*, 36*a*, 40*a*, and 44*a* using the existing torpedo tube flood and drain system.

The system is then unlocked from torpedo tube 96 by rotating breech door locking ring 98 and withdrawn by the torpedo rammer mechanism allowing UUV 108 to be secured to the breech end of torpedo tube 96 and released from recovery vehicle 56. Recovery device 10 is then fully withdrawn and moved to a convenient storage location. Once this is accomplished, UUV 108 can be withdrawn onto the torpedo tube load line.

The advantages of the present invention over the prior art are that this invention provides a low cost device for recovering underwater vehicles via a submarine's torpedo tubes. The underwater recovery device can be added to existing submarines without extensive modification to the submarine.

What has thus been described is an unmanned underwater vehicle recovery device joinable with the breech of an existing torpedo tube. The recovery device comprises a plurality of telescoping concentric tubes which extend through a torpedo tube to the exterior of the hull of a submarine to retrieve a UUV. A recovery vehicle on a deployable tether is launched from the recovery device in the torpedo tube. The recovery vehicle travels out and mates with a coupling at the rear of the UUV. The tether is retracted, and the joined recovery vehicle/UUV is pulled into the torpedo tube launchway. The concentric tubes are retracted and the UUV remains in the torpedo tube.

Obviously many modifications and variations of the present invention may become apparent in light of the above teachings. For example: the recovery vehicle can be a smaller size to allow easier withdrawal into the inner piston; UUV launch is not required to be from the same torpedo tube or the same submarine as that recovering the UUV; any torpedo tube can be used for the recovery operation, the preferred torpedo tube is the one with the lowest flow field forces; and the submarine can adopt a hovering position to reduce flow field forces while the UUV is being recovered.

In light of the above, it is therefore understood that within the scope of the appended claims, the invention may be practiced otherwise than as specifically described.

What is claimed is:

1. A recovery system used in conjunction with a submarine torpedo tube for recovering an underwater vehicle comprising:

an outer cylinder having a proximate end and a distal end, said distal end having fittings for mating with said torpedo tube on the interior of said submarine;

a plurality of telescoping pistons, including an innermost piston, disposed within said outer cylinder, said telescoping pistons being extensible through said torpedo tube to the exterior of said submarine;

a piston extension means for extending and retracting said telescoping pistons through said torpedo tube;

a recovery vehicle having a homing means, a control means, a coupling means and a guidance means therein, disposed within said innermost telescoping piston for travelling outside said submarine, homing in on said underwater vehicle, and coupling therewith; and a tether connected between said recovery vehicle and said telescoping pistons for withdrawing said recovery vehicle within said innermost telescoping piston.

2. The recovery system of claim 1 further comprising a plurality of extensible supports disposed on said submarine beyond said torpedo tube, said extensible supports being positioned to support said telescoping pistons when said recovery device is extended, and said supports being retractable.

3. The recovery system of claim 2 further comprising a cutting means interposed between said tether and said telescoping pistons for jettisoning said recovery vehicle by cutting said tether.

4. The recovery system of claim 3 wherein at least one of said telescoping pistons extends outside said submarine, said recovery system further comprising a jettison means interposed between said telescoping piston extending outside said submarine and another of said telescoping pistons for jettisoning said telescoping piston extending outside of said submarine.

5. A recovery system used in conjunction with a submarine torpedo tube for recovering an underwater vehicle comprising:

an outer cylinder, having a distal end and a proximate end, said proximate end being closed and said distal end being open with a mounting flange disposed thereabout for mounting said outer cylinder to said torpedo tube in said submarine;

an intermediate piston, having a distal end and a proximate end, said intermediate piston being disposed concentrically inside said outer cylinder and sealed against said outer cylinder at said proximate end of said intermediate piston, said intermediate piston and said outer cylinder having clearance therebetween to allow said intermediate piston to be extensible through said torpedo tube, said intermediate piston being open at both ends;

an inner piston, having a distal end and a proximate end, said proximate end being closed and said distal end being open, said inner piston being disposed concentrically inside said intermediate piston, said proximate end of said inner piston being sealed against said intermediate piston, and said inner piston and said intermediate piston having clearance therebetween to allow said inner piston to be extensible through said torpedo tube to the outside of said submarine;

a recovery vehicle with a proximate end and a distal end, said recovery vehicle having a propulsion means, a guidance means and an underwater vehicle attachment means, said recovery vehicle being disposed within said inner piston to allow said recovery vehicle to exit said inner piston through said open distal end thereof and retrieve said underwater vehicle by attaching thereto;

a piston extension means disposed between said outer cylinder and said inner piston for retracting and extending said intermediate piston and said inner piston;

a tether connected to said proximate end of said recovery vehicle for communicating with said recovery vehicle and connecting said recovery vehicle with said inner piston;

a tether winch disposed at the proximate end of said inner piston and connected to said tether for drawing said recovery vehicle into said inner piston after said recovery vehicle has exited said inner piston;

a source means disposed within said underwater vehicle for providing a signal to broadcast the location of said underwater vehicle; and a homing means disposed within said recovery vehicle and electrically connected with said guidance means to receive said signal transmitted from said source means aboard said underwater vehicle to allow said recovery vehicle to be guided to said underwater vehicle by said guidance means working in cooperation with said homing means.

6. The recovery system of claim 5 wherein said piston extension means further comprises:

a pump in communication with the proximate end of said outer cylinder for pumping seawater between said outer cylinder and said inner piston to push said inner piston and said intermediate piston toward said distal end of said outer cylinder;

a cable connected to said closed proximate end of said inner piston outside of said inner piston; and a retraction winch disposed at said proximate end of said outer cylinder and connected to said cable to allow said retraction winch to withdraw said cable thereby retract said inner piston.

7. The recovery system of claim 6 further comprising:

a conical mouth formed at the distal end of said inner piston with said conical mouth widening toward said distal end of said inner piston;

a conical retraction shroud disposed on said proximate end of said recovery vehicle to guide said recovery vehicle into said inner piston as said recovery vehicle is withdrawn by said tether; and a conical mounting shroud disposed on the tail of said underwater vehicle, said mounting shroud having the same angle and range of diameters as said conical mouth allowing said mounting shroud to nest inside said conical mouth to prevent said underwater vehicle from canting because of flow field forces when said underwater vehicle is withdrawn into said torpedo tube.

8. The recovery system of claim 7 further comprising a plurality of extensible supports disposed on said submarine beyond said torpedo tube, said extensible supports being positioned to support said inner piston when said recovery device is extended, and said supports being retractable.

9. The recovery system of claim 8 further comprising a cutting means interposed between said tether winch and said recovery vehicle for jettisoning said recovery vehicle by cutting said tether and releasing said recovery vehicle outside said submarine.

10. The recovery system of claim 9 further comprising a jettison means interposed between said tether winch and said inner piston for jettisoning said inner piston outside said submarine.

11. The recovery system of claim 10 wherein said jettison means further comprises:

an inner piston extension retaining cup having a wall and a base, said wall being disposed about said closed proximate end of said inner piston and said base being interposed between said inner piston and said tether winch, said wall having an annular cup locking groove disposed on the inner surface thereof and said base having an aperture therein to allow communication of said tether therethrough; and at least two ball lock devices disposed on said outer surface of said proximate end of said inner piston corresponding to said annular cup locking groove, said ball lock devices having a ball and a solenoid, said ball being controllable between locked and unlocked positions.

* * * * *